US005551934A

United States Patent [19]

Binette

[11] Patent Number: 5,551,934

[45] Date of Patent: Sep. 3, 1996

[54] PORTABLE GLUTEUS MAXIMUS EXERCISE MAT

[76] Inventor: Steve D. Binette, 3820 NW. 77th Ave., Hollywood, Fla. 33024

[21] Appl. No.: 433,261

[22] Filed: May 2, 1995

[51] Int. Cl.[6] ..... A63B 21/00

[52] U.S. Cl. ..... 482/123; 482/130; 482/142

[58] Field of Search ..... 482/123, 35, 140, 482/142, 121–126, 130

[56] References Cited

U.S. PATENT DOCUMENTS

| | | | |
|---|---|---|---|
| 1,623,671 | 4/1927 | Frankenfeld | 482/123 |
| 1,705,745 | 3/1929 | Anderson | 482/123 |
| 3,707,284 | 12/1972 | Waldeck | 482/123 |
| 4,089,520 | 5/1978 | Ozbey et al. | 272/136 |
| 4,340,218 | 7/1982 | Wilkinson | 272/136 |
| 4,403,773 | 9/1983 | Swann | 272/134 |
| 4,492,376 | 1/1985 | Schatz et al. | 272/138 |
| 4,609,193 | 9/1986 | Paris et al. | 272/145 |
| 4,856,775 | 8/1989 | Colledge et al. | 482/142 |

FOREIGN PATENT DOCUMENTS

| | | | |
|---|---|---|---|
| 2554356 | 5/1985 | France | 482/140 |
| 2562428 | 10/1985 | France | 482/142 |

*Primary Examiner*—Jerome Donnelly
*Attorney, Agent, or Firm*—Robert C. Kain, Jr.

[57] ABSTRACT

The portable exercise mat enables the user to exercise his or her gluteus maximus muscles by permitting the user to lift his or her thigh above a planar exercise mat face or surface. The mat includes a forward and a rearward mat section. The rearward planar mat section is joined by a hinge mechanism to the forward planar mat section. Both sections form a flat, enlarged mat system when it is open. The rearward mat section includes a reinforcement plate which, in a preferred embodiment, is located between upper and lower foam layers. The reinforcement plate spans at least thirty percent of the entire rear mat section and, in a preferred embodiment at least eighty percent of the lateral aspect of the rearward mat section. This plate permits the user to place his or her knee on a region atop the reinforcement plate and keep the exercise mat flat as he or she lifts his or her thigh above the exercise plane defined by the enlarged mat system. To provide tension and resist the upward movement of the user's thigh, the exercise mat includes an expansible exercise link having one end strapped to the thigh of the user and having the other end removably coupled to a mat mounted coupler.

10 Claims, 2 Drawing Sheets

PORTABLE GLUTEUS MAXIMUS EXERCISE MAT

BACKGROUND OF THE INVENTION

The present invention relates to a portable, gluteus maximus exercise mat.

U.S. Pat. No. 4,403,773 to Swann discloses an exercise apparatus having a flat, elongated rectangular support which is made of plywood or other material. Tensioning members can be attached by a snap hook to the flat plywood or rigid exercise board. The user attaches the tensioning member to his or her thigh or other appendage via a strap and a snap ring. The Swann exercising apparatus is not portable.

French patent publication 2,562,428 discloses an exercise apparatus having a horizontal bench. The bench is rigid and is further supported by short legs spaced about the periphery of the horizontal bench. The bench includes many attachments one of which is a pair of hinged, retractable plates that protrude above the exercise plane established by the horizontal bench. These retractable plates immobilize the feet of the user. The bench also includes a horizontal transverse roller or bar which extends above and is placed atop the exercise plane established by the rigid, horizontal bench. The exercise apparatus also includes springs having one end attached to the horizontal bench and the other end attached to a strap which the user grabs in order to exercise his or her body.

U.S. Pat. No. 4,492,376 to Schatz discloses a lower extremity exerciser which is a rigid exercise platform. U.S. Pat. No. 4,089,520 to Ozbey discloses an exercise apparatus which also includes a rigid exercise platform. U.S. Pat. No. 1,705,745 to Anderson discloses an exercise device with an open main frame and a plurality of minor upstanding frames against which the user leans during an exercise. U.S. Pat. No. 4,609,193 to Paris discloses a back and gluteus maximus exerciser configured as a collapsible frame device. U.S. Pat. No. 4,340,218 to Wilkinson discloses a resilient type exerciser mounted on a rigid, exercise platform. Several springs, attached to straps on the user and to a rigid exercise platform, permit the user to exercise his or her muscles.

OBJECTS OF THE INVENTION

It is an object of the present invention to provide a portable, gluteus maximus exercise mat.

It is another object of the present invention to provide a bi-folding exercise mat which can be easily carried by the user.

It is a further object of the present invention to provide an exercise mat which can be folded into a compact structure approximately one-half the size of the fully extended mat.

It is another object of the present invention to provide an exercise mat which is simple to use.

It is a further object of the present invention to provide an exercise mat which utilizes several different expansible exercise links (made of springs or expandable elastic material) to permit the user to adjust the tension during the gluteus maximus exercise routine.

SUMMARY OF THE INVENTION

The portable exercise mat enables the user to exercise his or her gluteus maximus muscles by permitting the user to lift his or her thigh above a planar exercise mat face or surface. The mat includes a forward and a rearward mat section. The rearward planar mat section is joined by a hinge mechanism to the forward planar mat section. Both sections form a flat, enlarged mat system when it is open. The rearward mat section includes a reinforcement plate which, in a preferred embodiment, is located between upper and lower foam layers. The reinforcement plate spans at least thirty percent of the entire rear mat section and, in a preferred embodiment at least eighty percent of the lateral aspect of the rearward mat section. This plate permits the user to place his or her knee on a region atop the reinforcement plate and keep the exercise mat flat as he or she lifts his or her thigh above the exercise plane defined by the enlarged mat system. To provide tension and resist the upward movement of the user's thigh, the exercise mat includes an expansible exercise link having one end strapped to the thigh of the user and having the other end removably coupled to a mat mounted coupler.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

Figure 1:
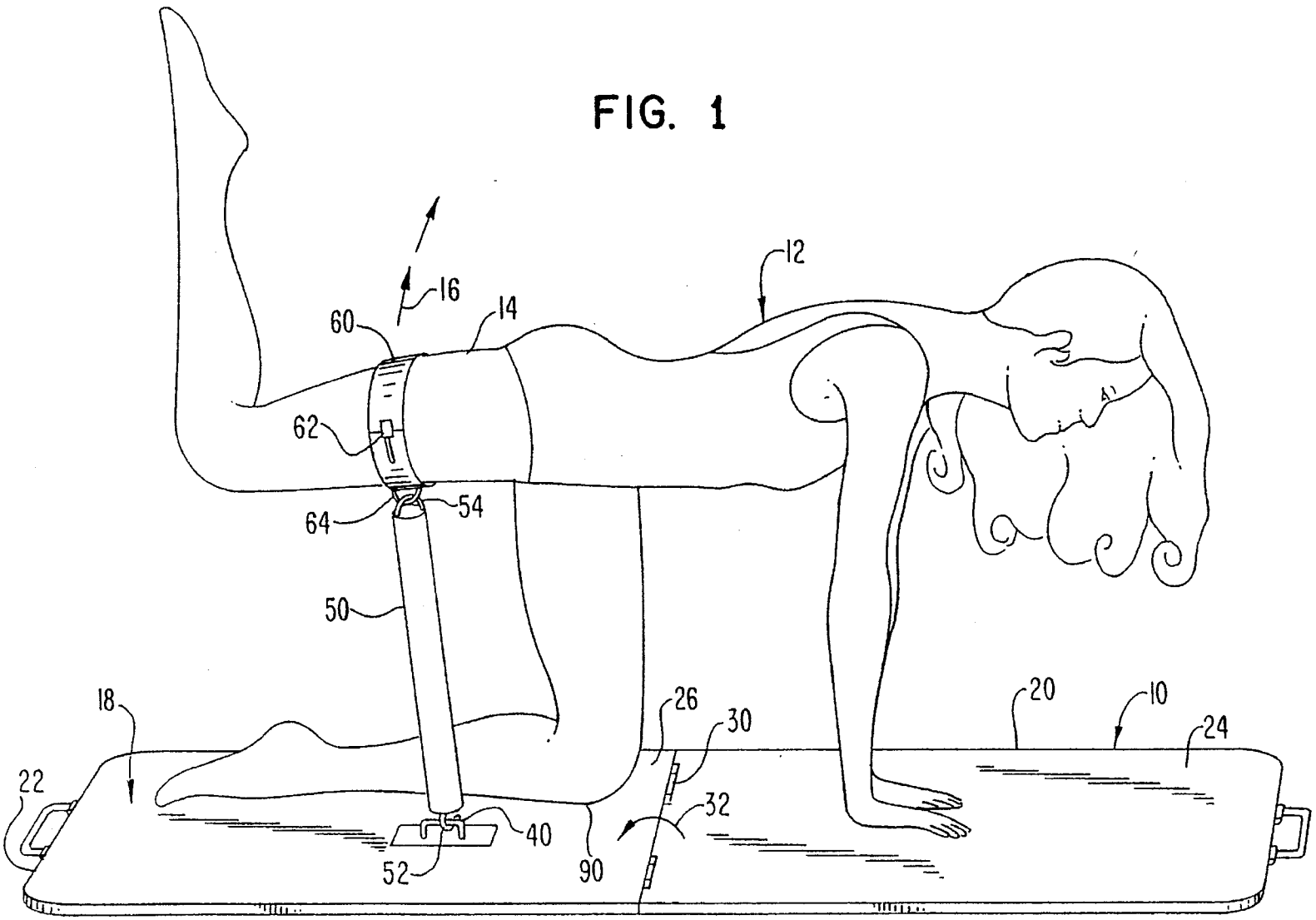
FIG. 1 diagrammatically illustrates the user exercising her gluteus maximus muscles atop an exercise mat configured in accordance with the principles of the present invention.
Figure 2:
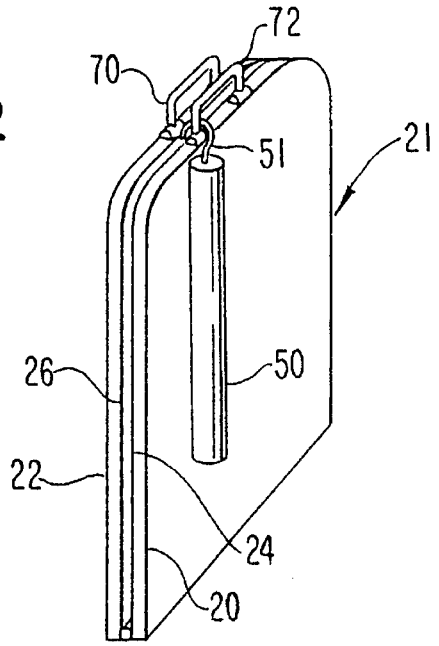
FIG. 2 diagrammatically illustrates the exercise mat in a portable, compact mode.

The present invention relates to a portable, gluteus maximus exercise mat that can be configured as a flat, enlarged mat system 10 shown in FIG. 1 or as a compact, portable device 21, shown in FIG. 2.

In FIG. 1, a user 12 is exercising her gluteus maximus muscle by raising thigh 14 in the upward direction shown by arrows 16. Thigh 14 is raised or lifted away from an exercise plane 18 which is defined by a forward mat section 20 and a rearward mat section 22. Forward mat section 20 includes a planar exercise mat face 24 which, in the operable mode shown in FIG. 1, is coplanar with planar exercise mat face 26 of rearward mat section 22. Mat section 20 is attached via a hinge mechanism 30 to rearward mat section 22. Hinge 30 may be similar to a common door hinge, that is, interlocking cylinders with a cylindrical solid pin running therethrough, or may be simpler such as a flexible strap which enables forward mat section 20 to rotate in the direction shown by arrow 32 towards rearward mat section 22.

It is important to note that forward mat section 20 does not include any apparatus or attachments rising above the exercise surface 24.

Rearward mat section 22 includes a substantially planar exercise surface 26 except for the mat mounted coupler 40. In the illustrated embodiment, mat mounted coupler 40 is a loop which rises only minimally (less than 0.5 inches) above plane 26. Coupler 40 may be a collapsible, resilient loop of elastic material such that it does not protrude above mat plane 26. Attached to mat mounted coupler 40 is an expansible exercise link 50. At one end, exercise link 50 includes a complimentary coupler 52 that is a removably attachable to mat mounted coupler 40. At the other end, exercise link 50 includes a strap coupler 54.

Attached to thigh 14 of user 12 is a strap mechanism 60. In FIG. 1, strap mechanism 60 is removably attachable to thigh 14 via a belt buckle mechanism 62. Strap 60 also includes a strap coupler 64 which is complimentary and removably attachable to coupler mechanism 54 on the exercise link 50.

FIG. 2 diagrammatically illustrates the exercise mat system wherein forward mat section 24 is collapsed and placed on top of rearward mat section 22. In this mode, exercise surface 26 abuts exercise surface 24 respectively associated with rearward mat section 22 and forward mat section 20. The user can carry the compact portable mat system 21 by grasping handles 70, 72. Expansible exercise link 50 can be easily attached via one of the couplers (illustrated as coupler 51 in FIG. 2) to one or both of handles 70, 72.

It is important to note that the portability of the exercise mat is an important feature. Accordingly, mat mounted coupler 40 extends a minimal distance 41 (FIG. 3) above exercise surface 26. Otherwise, the coupler is made of a flexible, collapsible material.

Figure 3:
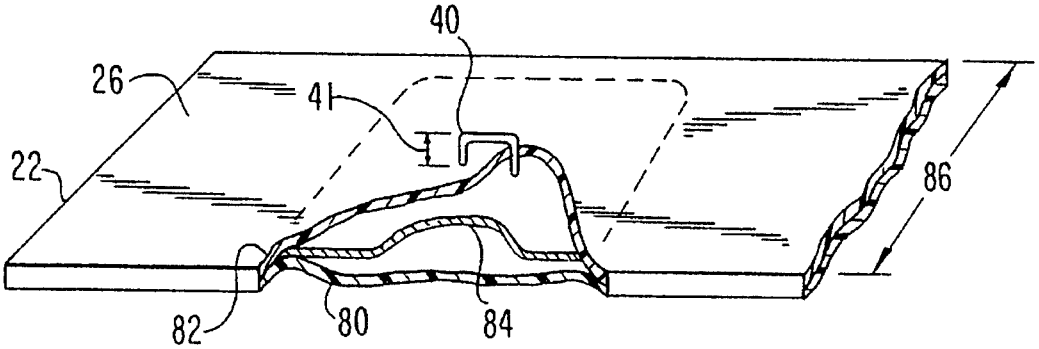
FIG. 3 diagrammatically illustrates a portion of the rearward mat section and particularly the mat mounted coupler and the reinforcement plate.

Another important feature of the present invention is shown in FIG. 3 which provides a partially broken away view of rearward mat section 22. Rearward mat section 22 is a composite structure including lower foam or compressible layer 80 and an upper foam or compressible layer 82. A reinforcement plate 84 is sandwiched or placed intermediate the upper and lower compressible foam structures 82, 80. Also, it is important that the reinforcement plate 84 occupy at least 30% of the rearward mat section area. Also, in a preferred embodiment, the reinforcement plate 84 spans at least 90% of the lateral distance 86 of the rearward mat section 22. Mat mounted coupler 40 is affixed in a permanent relationship to reinforcement plate 84. The size of reinforcement plate 84 is important because the user places his or her knee 90 (FIG. 1 ) on a region generally atop reinforcement plate 84. This enables the user to raise his or her thigh 14 above the exercise face plane 26 placing expansible link 50 under tension while the other knee rests atop reinforcement plate 84. Accordingly, the exercise mat is held in a firm, stable position on the ground plane during the gluteus maximus exercise.

Figure 4A:
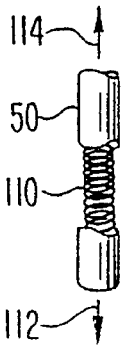
FIGS. 4A, 4B and 4C diagrammatically illustrate different expansible exercise links and strap attachments for the exercise links.
Figure 4B:
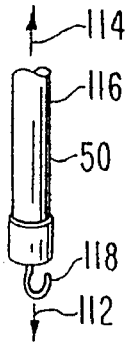

FIGS. 4A and 4B diagrammatically illustrate two types of expansible exercise links. In FIG. 4A, exercise link 50 includes an expandable spring 110. This spring permits the exercise link to expand as shown by arrows 112 and 114. In FIG. 4B, expansible exercise link 50 is configured as an elastic band type material 116. A coupler hook 118 is disposed at one end of the elastic band 116. The user moves his or her thigh away from exercise plane 26 thereby developing forces as shown by arrows 112 and 114 in FIG. 4B.

Figure 4C:
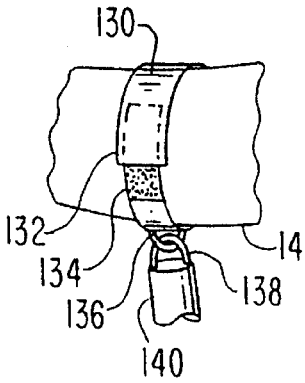

FIG. 4C diagrammatically illustrates a portion of thigh 14 and a strap 130. Strap mechanism 130 is firmly affixed, in a removable manner, to thigh 14 due to VELCRO or hook and loop cloth structure which has one complimentary hook or loop structure under end 132. Atop the other end 134, the complimentary hook or loop cloth structure is provided. The strap 130 includes a strap coupler 136 which is attached to link coupler 138. The terminal end 140 of an expansible exercise link is shown in FIG. 4C.

The claims appended hereto are meant to cover modifications and changes within the spirit and scope of the present invention.

What is claimed is:

1. A portable exercise mat enabling a user to exercise his or her gluteus maximum muscles comprising a forward, planar mat section forming a singular, entirely flat and planar forward exercise surface and a rearward, planar mat section forming a singular, entirely flat and planar rearward exercise surface made of a flexible compressible material, both joined together with a hinge mechanism such that in a first, operable mode, said forward and rearward mat sections are coplanar and form a flat enlarged mat system with said forward and rearward exercise surfaces being coplanar without any elements rising thereabove, and in a portable mode, said forward and rearward mat sections having respective planar exercise surfaces disposed adjacent each other; said rearward exercise mat section having only one centrally located coupler mounted therein, said coupler being exposed to said corresponding planar exercise surface, said coupler mounted to a centrally located reinforcement plate occupying at least 30% of said rearward mat section; an expansible exercise link with a complementary coupler at one end thereof, said complementary coupler being removably attached to the mat mounted coupler, said expansible exercise link having a strap at an opposite end thereof which strap is attachable to a thigh of said user, whereby in said operable mode, said user attaches said strap onto his or her thigh, attaches said mat mounted coupler to said complementary coupler on said expansible exercise, link, places an opposing knee, opposite the strapped thigh, atop said rearward mat section and said centrally located reinforcement plate and lifts said strapped thigh away from said corresponding planar exercise mat surface thereby causing said expansible exercise link to resist said lifting of said strapped thigh.

2. An exercise mat as claimed in claim 1 wherein said reinforcement plate is disposed between two compressible mat layers which together comprise said rearward exercise mat section.

3. An exercise mat as claimed in claim 1 wherein said forward and rearward mat sections, when laid out as said flat enlarged mat system, form a rectangular mat system having a longitudinal aspect which is longer than a lateral aspect, said reinforcement plate in said rearward mat section spanning at least 80% of the lateral aspect of said rearward mat section such that the rearward section of the mat is adapted to allow said user to place his or her knee on a region atop said reinforcement plate.

4. An exercise mat as claimed in claim 2 wherein said expansible exercise link includes a spring.

5. An exercise mat as claimed in claim 2 wherein said expansible exercise link includes an elongated elastic material.

6. An exercise mat as claimed in claim 2 wherein said strap is one of a belt buckle mechanism or a hook and loop cloth attachment.

7. An exercise mat as claimed in claim 2 wherein said forward and rearward mat sections, when laid out as said flat enlarged mat system, form a rectangular mat system having a longitudinal aspect which is longer than a lateral aspect, said reinforcement plate in said rearward mat section spanning at least 80% of the lateral aspect of said rearward mat section such that the rearward section of the mat is adapted to allow said user to place his or her knee on a region atop said reinforcement plate.

8. An exercise mat as claimed in claim 7 wherein said expansible exercise link includes one of a spring or an elongated elastic material.

9. An exercise mat as claimed in claim 8 wherein said strap is one of a belt buckle mechanism or a hook and loop cloth attachment.

10. An exercise mat as claimed in claim 8 wherein in said portable made, substantially all of said rearward exercise mat surface and said forward exercise mat surface abut each other whereby the user can carry said exercise mat as a compact, unitary structure, said forward and rearward mat sections having carrying handles mounted on opposite edges faces thereof whereby said user can carry the compact exercise mat in said portable mode.

* * * * *